US008100703B2

(12) United States Patent
Chen

(10) Patent No.: US 8,100,703 B2
(45) Date of Patent: Jan. 24, 2012

(54) ELECTRICAL CONNECTOR WITH ABUTTING RIBS AGAINST PCB

(75) Inventor: De-Jin Chen, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/875,681

(22) Filed: Sep. 3, 2010

(65) Prior Publication Data

US 2011/0059634 A1 Mar. 10, 2011

(30) Foreign Application Priority Data

Sep. 4, 2009 (CN) ..... 200920309647.7

(51) Int. Cl.
*H01R 12/00* (2006.01)

(52) U.S. Cl. ..... 439/83

(58) Field of Classification Search ..... 439/83, 439/78, 876, 476, 476.1, 856, 857
See application file for complete search history.

(56) References Cited

U.S. PATENT DOCUMENTS 4,077,693 A * 3/1978 Briel et al. ..... 439/545
5,277,597 A * 1/1994 Masami et al. ..... 439/83
5,383,797 A * 1/1995 Seong et al. ..... 439/569
5,961,339 A 10/1999 Koopman et al.
6,287,130 B1 * 9/2001 Torii ..... 439/83
6,860,765 B1 * 3/2005 Spink, Jr. ..... 439/680
7,789,677 B2 * 9/2010 Yang et al. ..... 439/83
2002/0111064 A1 * 8/2002 Kohno ..... 439/547

* cited by examiner

*Primary Examiner* — Tulsidas C Patel
*Assistant Examiner* — Harshad Patel
(74) *Attorney, Agent, or Firm* — Wei Te Chung; Andrew C. Cheng; Ming Chieh Chang

(57) ABSTRACT

An electrical connector includes a plurality of terminals with tail portions and an insulating housing defining a mounting face and a mating face opposite to the mounting face. The insulating housing includes a plurality of parallel first walls extending in a first direction and a plurality of parallel second walls extending in a second direction perpendicular to the first direction and unitarily intersecting with the first walls to construe a plurality of passageway to receive the terminals. The tail portions of the terminals extend beyond two outermost first walls in the second direction. A pair of first ribs extends from one second wall away from the mounting face and the ribs do not exceed the outermost first walls in the second direction.

14 Claims, 6 Drawing Sheets

ELECTRICAL CONNECTOR WITH ABUTTING RIBS AGAINST PCB

BACKGROUND OF THE INVENTION

1. Field of the Invention

The present invention generally relates to an electrical connector which is mounted on a printed circuit board.

2. Description of the Prior Art

U.S. Pat. No. 5,961,339 discloses an electrical connector mounted on a PCB. The connector defines a pair of guiding posts on a mounting face thereof and the PCB defines a pair of guiding holes. The connector can be put to a predetermined position through the guiding of the posts and the holes. Sometimes, the position process might be cost a long time since the posts and holes are small in dimension. A better assembly efficiency of the connector to the PCB is needed.

Hence, an improved electrical connector is desired to overcome the disadvantages of the prior art.

BRIEF SUMMARY OF THE INVENTION

Therefore, an object of the present invention is to provide an electrical connector having a position spacer which has guiding means to the terminals.

To fulfill the above-mentioned object, an electrical connector comprises a plurality of terminals comprising tail portions and an insulating housing defining a mounting face and a mating face opposite to the mounting face. The insulating housing comprises a plurality of parallel first walls extending in a first direction and a plurality of parallel second walls extending in a second direction perpendicular to the first direction and unitarily intersecting with the first walls to construe a plurality of passageway to receive the terminals. The tail portions of the terminals extend beyond two outermost first walls in the second direction. At least one first rib extends from one second wall away from the mounting face and the at least one rib do not exceed the outermost first walls in the second direction.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Reference will now be made in detail to the preferred embodiment of the present invention.

Figure 1:
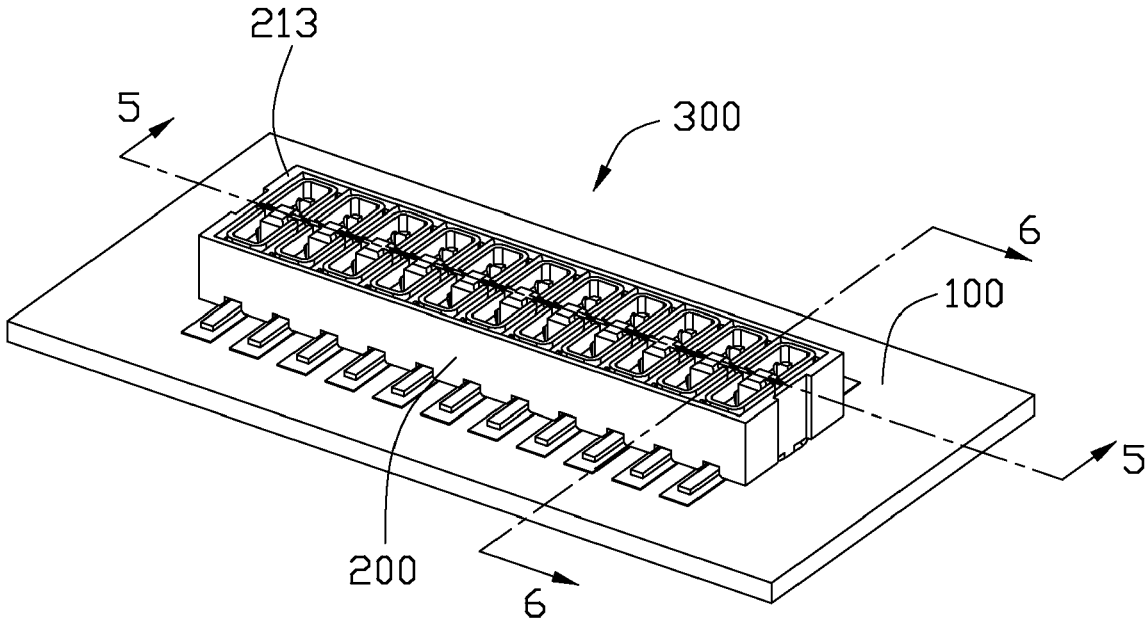
FIG. 1 is a top assembled perspective view of an electrical connector assembly made in accordance with the present invention.
Figure 2:
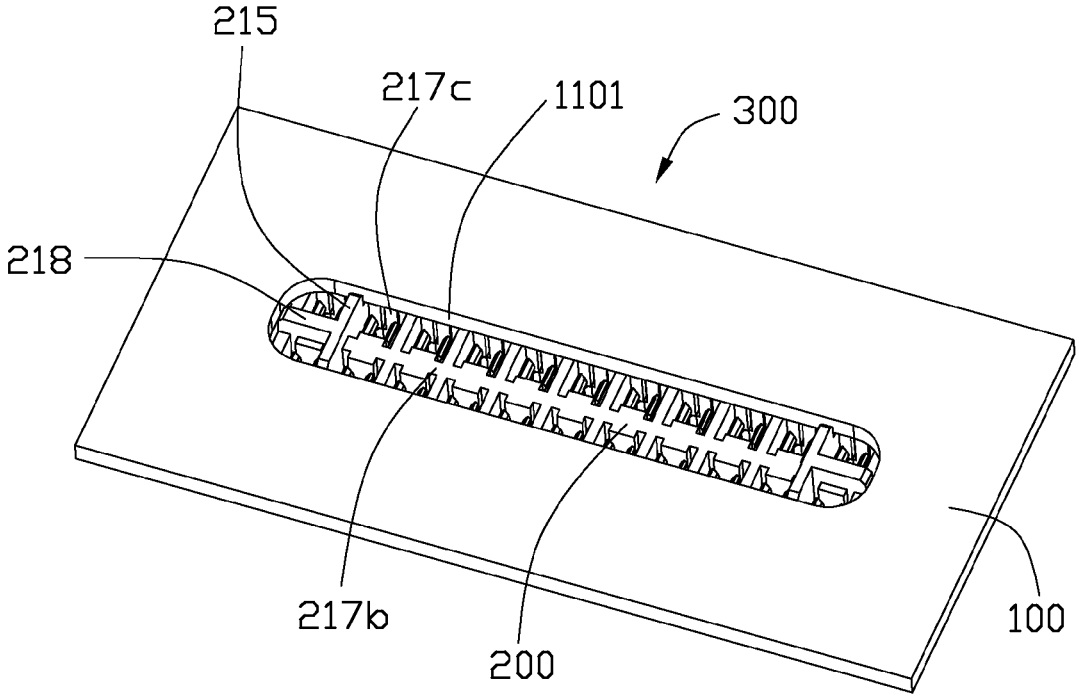
FIG. 2 is a bottom assembled perspective view of the electrical connector assembly.

With reference to FIGS. 1-2, an electrical connector assembly 300 in accordance with the present invention is provided, which include a printed circuit board 100 (PCB) and an electrical connector 200.

Figure 3:
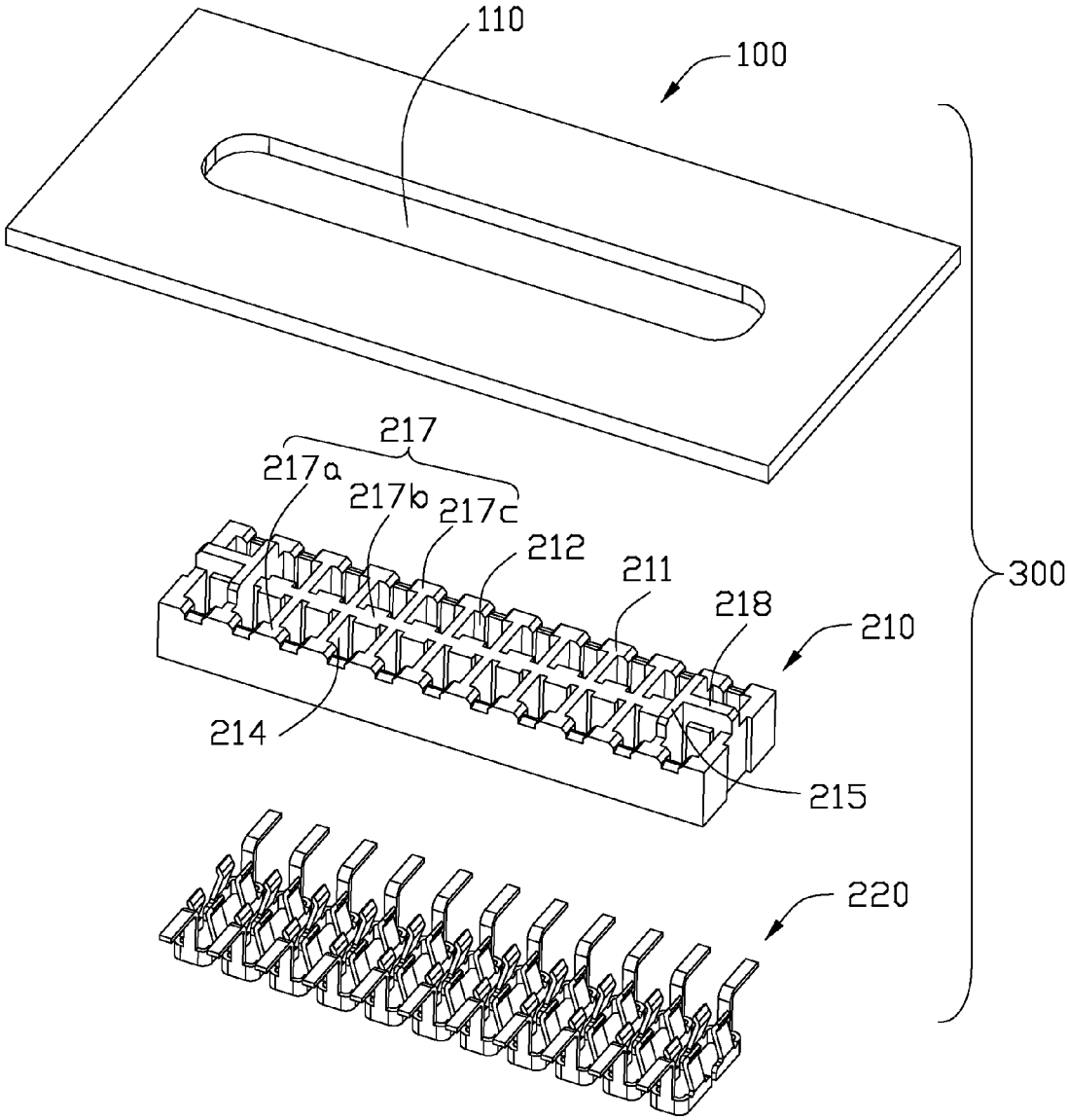
FIG. 3 is an exploded perspective view of the electrical connector assembly from a bottom view.
Figure 4:
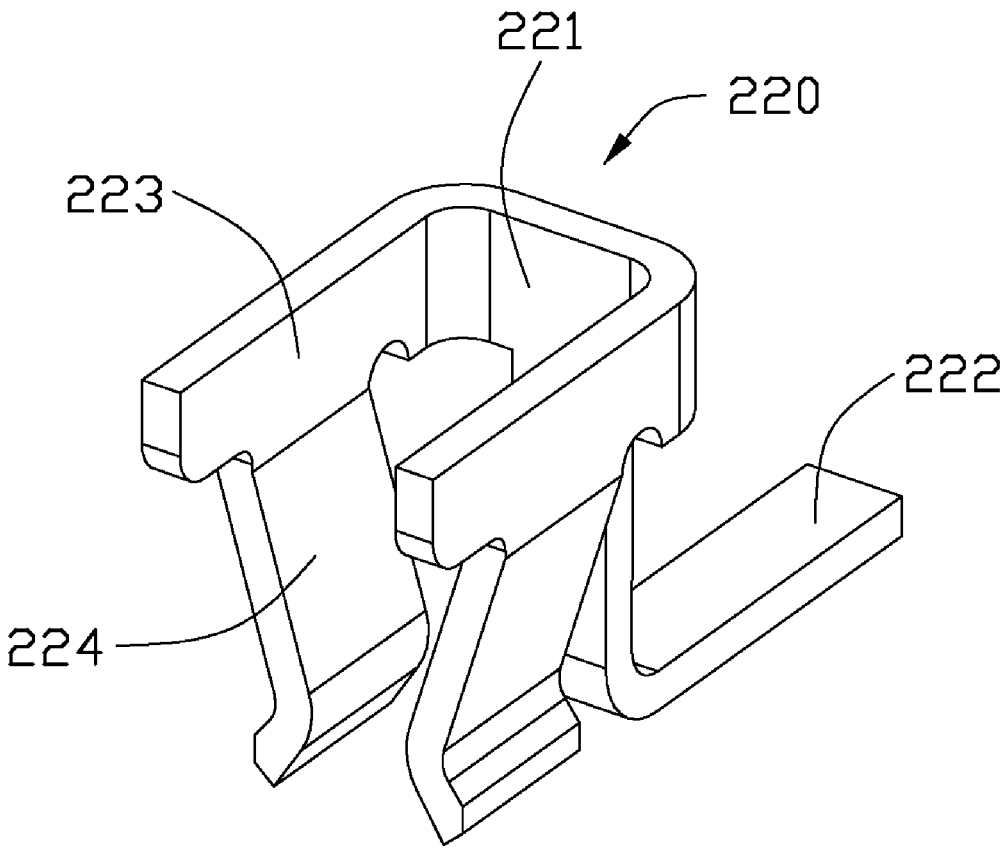
FIG. 4 is a perspective view of the terminal.

Referring to FIG. 3 the electrical connector 200 includes an insulating housing 210 and two rows of terminals 220. The insulating housing 210 defines a mounting face 211, a mating face 213 (labeled in FIG. 1) opposite to the mounting face 211 and a plurality of passageways 212 through said two faces. The passageways 212 are construed with a matrix pattern, in a preferred embodiment the passageways 212 are arranged in two rows and each row extend in a first direction. The insulating housing has three parallel long walls 217 or first walls extending in the first direction and a plurality of parallel short walls 214 or second walls perpendicular to and unitarily intersecting with the long walls 217 in a second direction, thereby each passageway is construed.

Referring to FIGS. 2 and 3, each terminal 220 includes a U-shaped base portion which includes a middle arm 221 and two parallel side arms 223 at two sides of the middle arm, a tail portion 222 extending downward from the middle arm of the base portion and a pair of elastic portions 224 in the shape cantilever arm extending downward from the side arms 223. The terminals are inserted in the passageways 212 from the mounted face 211. The tail portions extend perpendicularly beyond the two outermost long walls 27*a*, 27*c*. The pairs of elastic portions 224 contained in the passageways, are arranged along the first direction. The elastic portions of each pair more slantwise toward each other more to the mounting face 211.

Please referring to FIG. 3, two first ribs 215 unitarily extend downward from the two short walls 21s which are the second one of the short walls near to two distal ends of the rows, and far away from the mounting face 211. The first ribs do not exceed the two outermost long walls 217 in the second direction. Two second ribs 218 unitarily extend downward from the middle long wall 27*b* beyond the mounting face 211 and intersect with the corresponding first ribs. The second ribs are aligned with the distal ends of the rows. The first and the second ribs have a same height and are formed in a T shape.

Figure 5:
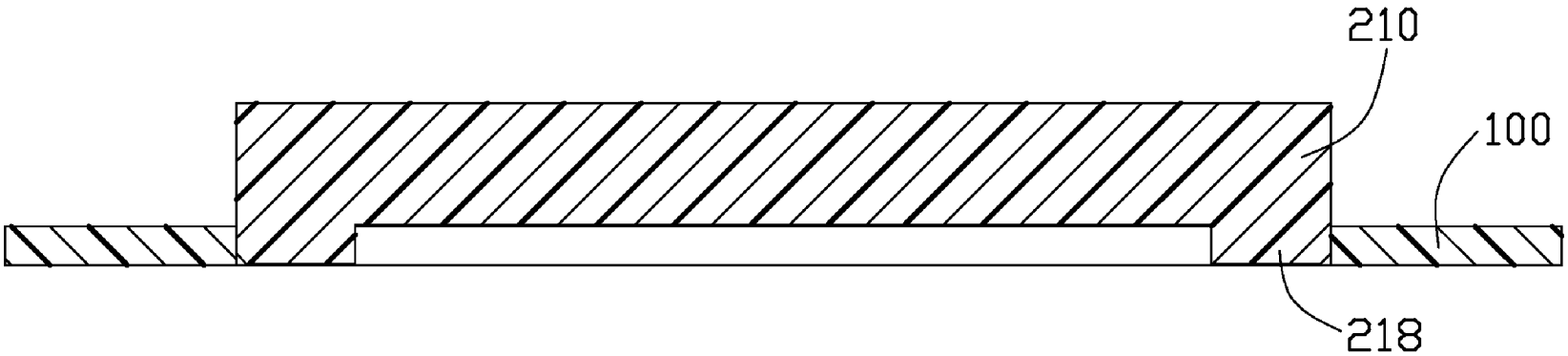
FIG. 5 is a cross sectional view of the electrical connector assembly taken along line 5-5 in FIG. 1.
Figure 6:
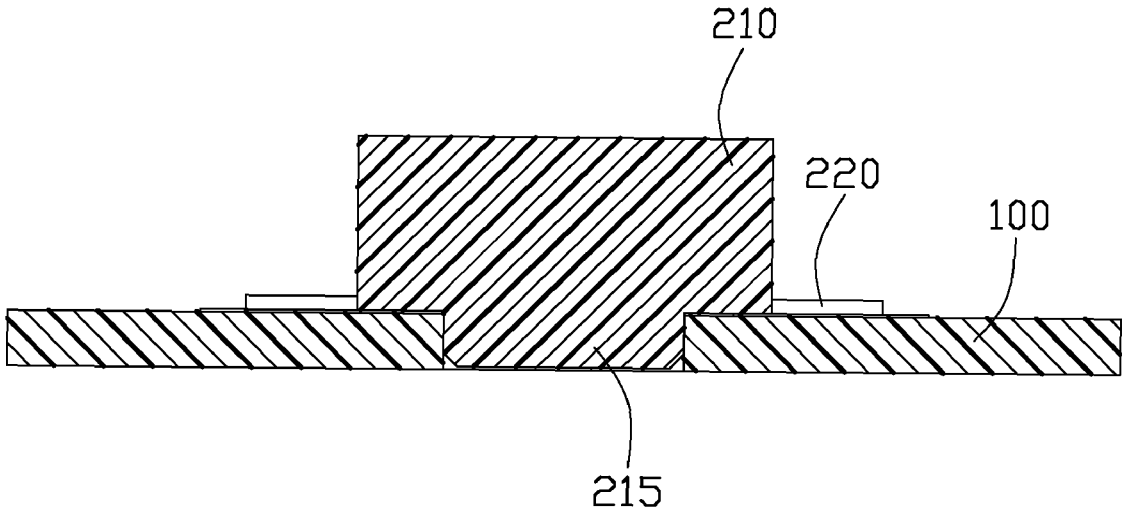
FIG. 6 is a cross sectional view of the electrical connector assembly taken along line 6-6 in FIG. 1.

The PCB defines a long open 110 extending in the first direction. The first and second ribs 215,218 can guide the connector to the long open 110 observing though the long open. Seeing FIGS. 1 and 2, the connector is seat on the PCB by the outermost long wall 217*a*, 217*c* on one surface of the PCB. Combination with FIGS. 5 and 6, the first ribs 215 abut against the longer inside edges 101 of the long open and the second ribs 218 abut against the short inside edges of the long open. The first ribs 215 also limit the connector to avoid shifting in the second direction and the second ribs 218 limit the connector to avoid shifting in the first direction. The tail portions 222 are soldered to conductive pads on the PCB to retain the connector on the PCB and complete electrical connection. Moreover, the ribs interfere with the side of the long open to further retain the connector on the PCB.

Alternatively, if an electrical connector has only two long wall, the first ribs can disposed the short wall but do not exceed the long walls in the second direction, as a result that the long wall can provide a mounting face to confront with the PCB, and the second ribs is omitted. If an electrical connector has more than three long walls, the first ribs and the second ribs can be disposed in multi-patterns. If the ribs are too long, the rib can be interrupted.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a plurality of terminals comprising tail portions;

an insulating housing defining a mounting face and a mating face opposite to the mounting face, the insulating housing comprising a plurality of parallel first walls extending in a first direction and a plurality of parallel second walls extending in a second direction perpendicular to the first direction and unitarily intersecting with the first walls to construe a plurality of passageway to receive the terminals, the tail portions of the terminals extending beyond two outermost first walls in the second direction;

wherein at least one first rib extends from one second wall away from the mounting face and the at least one rib do not exceed the outermost first walls in the second direction;

at least one second rib extend from a middle one of the first walls away from the mounting face and the at least one second rib joins with the at least one first rib.

2. The electrical connector as claimed in claim 1, wherein each of the terminals comprises a base portion retained in the passageway adjacent to the mating face of the insulating housing and a pair of elastic portions adjacent to the mounting face.

3. The electrical connector as claimed in claim 2, wherein the tail portions extend from the base portion.

4. An electrical connector assembly comprising:

a printed circuit board defining thereof a first surface and therein an opening with opposite first sides;

an electrical connector seating on the first surface of the printed circuit board, the electrical connector comprising:

an insulating housing defining a mounting face confronting with the first surface of the printed circuit board and at least one first rib unitarily extending from the mounting face into the opening of the printed circuit board and abutting against said opposite first sides of the opening of the printed circuit board;

a plurality of terminals comprising tail portions connecting with said first surface of printed circuit board.

5. The electrical connector as claimed in claim 4, wherein the first sides are longer than other sides, the tail portions of the terminals are located corresponding to the first sides.

6. The electrical connector as claimed in claim 5, wherein the insulating housing defines at least one second rib abutting against said other sides.

7. The electrical connector as claimed in claim 6, wherein the at least one first rib joins with the at least one second rib perpendicularly.

8. The electrical connector assembly as claimed in claim 4, wherein the opening is dimensioned to be similar to the housing along a lengthwise direction.

9. An electrical connector assembly comprising:

a printed circuit board defining an elongated opening through opposite first and second surfaces thereof;

an insulative housing defining a mounting face seating on the first surface of the printed circuit board and a mating face opposite to the mounting face;

a plurality of passageways formed in the housing, each of said passageways defining an opening around the mounting face to communicate the passageways with an exterior in a vertical direction;

a plurality of contacts disposed in the corresponding passageways, respectively, each of said passageways being configured to allow corresponding contact to be assembled thereinto only via the corresponding opening; wherein each of said contacts defines a solder tail horizontally outwardly extending around the mounting face;

wherein the openings of the passageways are exposed to the exterior via the elongated opening of the printed circuit board.

10. The electrical connector assembly as claimed in claim 9, wherein the mounting face defines a plurality of recesses corresponding to the passageways around the corresponding openings, respectively, to receive the solder tails of the corresponding contacts.

11. The electrical connector assembly as claimed in claim 9, wherein a pair of protrusions are formed at two opposite longitudinal ends of on the mounting face and projecting into the elongate opening of the printed circuit board with a predetermined distance.

12. The electrical connector assembly as claimed in claim 11, wherein a dimension defined by said pair of protrusions are smaller than the elongate opening in a lengthwise direction perpendicular to said vertical direction, and the mounting surface is larger than the elongate opening in a lateral direction perpendicular to both said vertical direction and said lengthwise direction.

13. The electrical connector assembly as claimed in claim 12, wherein said pair of protrusions are intimately received in said elongated opening in both a longitudinal direction and a lateral direction of the elongated opening.

14. The electrical connector assembly as claimed in claim 13, wherein said pair of protrusions does not extend beyond the second surface of the printed circuit board in said vertical direction so as to be essentially snugly received in the elongated opening.

* * * * *